US005628508A

United States Patent [19]

Koole

[11] Patent Number: 5,628,508

[45] Date of Patent: May 13, 1997

[54] BASKETBALL-STAND

[75] Inventor: Peter M. Koole, Kloetinge, Netherlands

[73] Assignee: Schelde International B.V., Netherlands

[21] Appl. No.: 664,295

[22] Filed: May 21, 1996

[51] Int. Cl.[6] ..... A63B 63/08

[52] U.S. Cl. ..... 273/1.5 R; 248/188.3

[58] Field of Search ..... 273/1.5 R, 1.5 A; 248/188.2, 188.3

[56] References Cited

U.S. PATENT DOCUMENTS

| | | | |
|---|---|---|---|
| 3,137,502 | 6/1964 | Duganich | 273/1.5 R |
| 3,841,631 | 10/1974 | Dolan | 248/188.2 |
| 4,412,679 | 11/1983 | Mahoney et al. | 273/1.5 R |
| 5,100,132 | 3/1992 | Anderson et al. | 273/1.5 R |

OTHER PUBLICATIONS

Basketball Products International, Inc., 95–96 Product Catalog pp. 38–40 Jun. 1995.

*Primary Examiner*—Paul E. Shapiro

*Attorney, Agent, or Firm*—Brooks & Kushman P.C.

[57] ABSTRACT

A portable wheeled basketball stand has a base which carries at least one support system and a beam for attachment of a backboard and ring. The beam, and thereby the stand, is capable of being moved between a lower, storage, position and a higher, playing position. Power storage springs act between a point connected to the base and a point connected to the at least one support system, and accumulate power when the stand is brought into its storage position. The power is relieved and the accumulated energy in the springs is freed when the stand is brought into its playing position. The base carries rods which are driven downwardly from the base by energy stored in the power storage springs when the beam is brought into its playing position. The rods are connected to a frame for engaging a surface on which the stand is positioned and lift at least a part of the stand from the floor as the stand is brought into its playing position for lifting at least some of the wheels off the surface and thus inhibiting movement of the stand during play.

8 Claims, 5 Drawing Sheets

BASKETBALL-STAND

BACKGROUND OF THE INVENTION

State of the Art

The invention relates to a basketball-stand, comprising a base which carries at least one support system which in turn carries a beam provided with means for attachment of a back-board and dunk ring, said beam—and thereby the stand—being capable of being moved between a lower or storage position and a higher or playing position, power storage means being provided, acting between a point connected to said base and a point connected to said at least one support system, and accumulating power when the stand is brought into its storage position, which power is relieved and the accumulated energy allowed to be freed when the stand is brought into its playing position.

Said power storage means are usually resilient means, more particularly a packet of springs. The springs are adjustable, and they are tensioned when, by manual force, the beam which carries backboard and dunk ring is brought down, with manual force, from its playing position into its storing position.

The assignee company has manufactured and marketed basketball-stands of this type, provided with means for lifting at least part of the weight of the stand from the floor so as to immobilize the stand in its playing position with respect to the playing field, and especially to prevent the wheels from gripping the ground and rolling away. These means were formed by a pair of threaded rods, mounted vertically near the front corners of the base in corresponding internally threaded bushes, these threaded rods being provided each with a hand-wheel at the top and a foot-plate to rest upon the floor when, by turning the wheels, the rods were brought down, first simply into contact with the floor, done by continuing to exert a turning force on the wheels, to at least partially lift the whole basketball-stand a little. For the ultimate security against horizontal movements in all directions, particularly during the game, there were two manually operable pins which could be let down into specially made holes in the floor. Nevertheless these floor pins alone were certainly not enough, and a certain minimum of upward displacement of the base and the wheels was necessary. Turning the wheels was therefore a task which required a quite considerable manual effort.

OBJECTS OF THE INVENTION

The main object of the invention, therefore, is to obviate this problem and to avoid the necessity of manually operating handwheels when arranging a basketball-stand for its proper game position.

Another object is to prevent any and all manual effort for the purpose of lifting at least part of the weight of the stand before securing it finally by means of floor pins.

SUMMARY OF THE INVENTION

These objects are realized when said base carries means, capable of being driven by said power storage means, for lifting at least part of the weight of the stand from the floor.

The invention is based upon the understanding that, although turning wheels of lifting rods requires quite some force by hand, the total amount of power necessary for this job is relatively small in comparison with the power which is necessary to bring the beam from its storage position into its playing position. Therefore the power storage means for lifting the beam—usually the packet of springs—can be utilized for this, instead of manual labour. In practice it is not even necessary to redesign the power storage means—particularly the springs—although slightly stronger springs might be used in the overall design dimensions.

Preferably the idea is realized in this way that said means capable of being driven by said power storage means comprise cam and rod means, said at least one support system being provided with at least one eccentric cam, fixedly connected thereto at a place such that the axis of rotation of the eccentric cam coincides with the pivot axis of that particular support system relative to said base, said base slidably vertically carrying rod means, the upper end of which is capable of being driven by an element which is located opposite the cam surface of said eccentric cam such that said element will be displaced by the eccentric cam surface to the extent that, during rotation of said eccentric cam, the cam radius increases from a lower to a higher radius value, said rod means being arranged such that, when it slides, under control of the displacement of said element, it is capable of lifting at least part of the weight of the stand from the floor.

SHORT DESCRIPTION OF THE DRAWINGS

FIG. 1 diagrammatically represents the basketball-stand in side view, in its lower or storage position.

Figure 6:
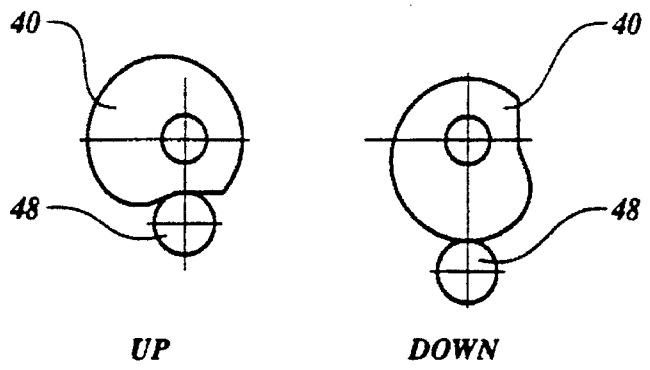

FIG. 6 diagrammatically clarifies the function of the cam.

DESCRIPTION OF THE PREFERRED EMBODIMENT

Figure 1:
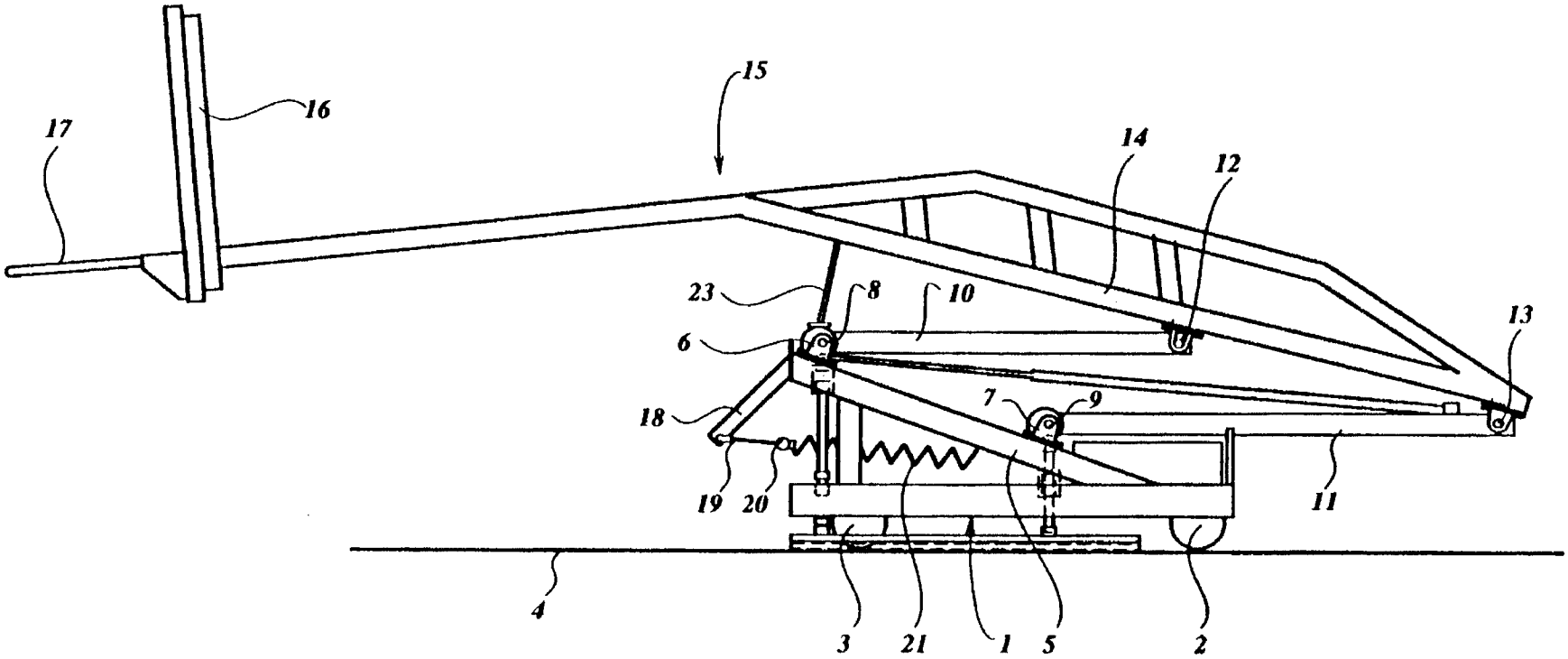

The main structural elements of the basketball-stand, and the manner in which they cooperate, appear most clearly from the diagrammatical representation of FIG. 1. A base is designated by 1, the base frame of which carries a pair of rear wheels 2 and a pair of front wheels 3, by which the stand is capable of rolling over floor 4.

The base further comprises a pair of inclined girders 5 on top of which front bearing blocks 6 and rear bearing blocks 7 are fixedly attached. Thereby front pivot pins 8 and rear pivot pins 9 enable a front joke 10 and a rear joke 11, respectively, to pivot with respect to base 1.

The opposite ends of jokes 10 and 11 are similarly capable of pivoting, by means of pairs of pivot pins not visible in FIG. 1, in bearings 12 and 13, respectively, all fixedly attached to a beam element 14 which constitutes part of what is called the beam 15 of the stand. Beam 15, at its far end, is provided with means for attachment of the back-board 16 and the dunk ring 17.

Figure 2:
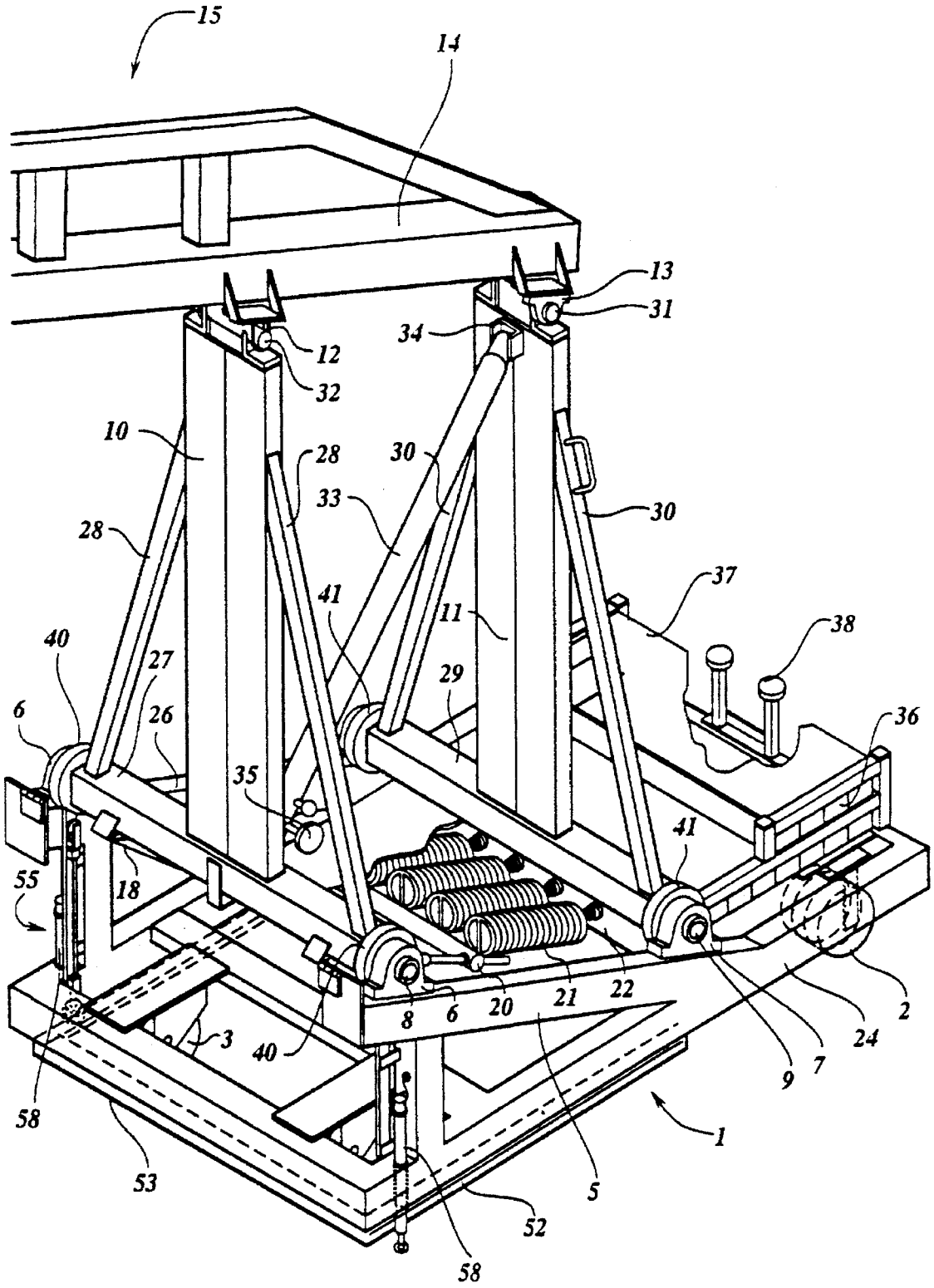
FIG. 2 represents the basketball-stand in its higher or playing position in more detail in an isometric view with parts, in a plurality of places, being shown broken-away.

Returning to the pivoting system: the four pivot axes of the respective pivot pins are all parallel to one another, oriented perpendicularly to the sheet of the drawing, so that jokes 10, 11, the part of girders 5 between pivot pins 6, 7 and the part of beam element 14 between the pivot pins supported by bearings 12, 13, form a quadrangular system of links which allows beam 15 to move with respect to base 1, from the position of FIG. 1 to the position of FIG. 2 which will be discussed in detail below.

Figure 3:
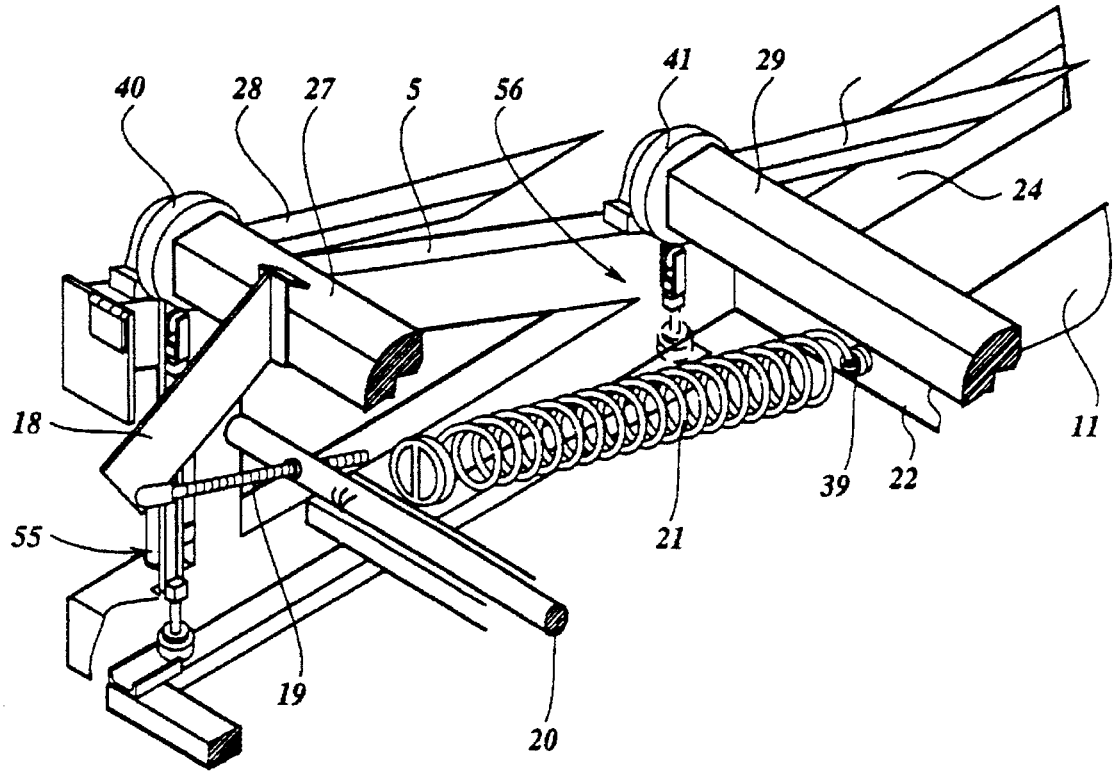
FIG. 3 is a detail, seen under the same angle as FIG. 2, at the far side of the stand, all the rest of the stand being broken away in order to make certain parts visible.

Fixedly connected to pivot pin 8 of the front joke is a pair of lever arms 18 which, in the lower or storage position of FIG. 1, points downwardly and forwardly under an angle which is roughly 45° with respect to the vertical (the exact value of this angle is not essential for its function). At the free ends of lever arms 18 a rods 19 engage a hole in the lever arms. Rods 19 in turn are attached to a connection tube 20 for a set of springs 21. The opposite ends of springs 21 are connected to a profile 22, not visible in FIG. 1 but visible in FIG. 3, which profile is welded to base 1. Springs 21 are draw springs. By bringing beam 15 into its lower position as represented in FIGS. 1 and 3, the springs will be extended, build up tension and accumulate energy. Therefore, in this lower position of the stand, springs 21 will continuously exert a pulling force onto lever arms 18 which will tend to make front joke 10 rotate in counter-clockwise direction in the drawing, corresponding to movement of beam 15 towards its higher or playing position. In order to prevent this during storage, a clamp 23 is provided between beam element 14 and a point which is integral with either the top end of base girder 5 or the pivot spindle to which pivot pins 8 of front joke 10 belong. As soon as clamp 23 is detached, the energy accumulated in the packet of springs 21 is balanced and the basketball-stand will therefore start to move into its playing position.

FIG. 2 is an isometric view under angles from the front, the side and above, so that the structure in three dimensions can be understood. The difference with respect to FIG. 1 is, moreover, that FIG. 2 represents the higher or playing position of the basketball-stand.

Base 1 is composed of a rectangular frame 24. There are rear wheels 2 on either side, having a fixed axis of rotation with respect to base frame 24. Front wheels 3, also two in number, are castor wheels which allow easy manoeuvring when the stand is being rolled. On either one of the longitudinal members of the frame there is a girder 5, although only the near one is visible because the far one, at the other side of the base-frame, is hidden by a cover plate 26 which hides the packet of springs 21 from view. Front bearing blocks 6 are seen to be a number, one on each of girders 5. This is also true for rear bearing block 7, although the far one thereof is hidden from view. Front pivot pins 8 carried by bearings 6 project from either end of what in this embodiment is a square pivot spindle 27 for front joke 10 which is a single element with a rectangular cross-section, attached centrally to pivot spindle 27. Two struts 28 on either side provide necessary stiffness. With a similar construction rear joke 11 is an element of rectangular cross-section, fixedly attached to pivot spindle 29, the opposite ends of which carry pivot pins 9 which will rotate in bearing blocks 7. Struts 30 provide the stiffness in this case. The top of rear joke 11 carries a pivot pin 31 supported in bearing block 13 which is attached to the element 14. Bearing 12 of front joke 11 has a more simplified structure in that it allows some play of pivot pin 32 in vertical direction as is usual with this type of basketball-stand.

In the upright position of jokes 10 and 11, which gives the playing position of the backboard and the ring at the end of beam 15, the exact vertical height of the ring can be adjusted by telescoping rod 33, the telescoping tube thereof being attached at 34 near the top of joke 11, the telescoping rod at the opposite end being attached near the lower end of joke 10 or pivot spindle 27 thereof; thus telescoping rod 33 extends more or less diagonally inside the quadrangular system of links constituted by jokes 10, 11, beam element 14 and girders 5. Visible in FIG. 2 knob 35 of the system which fixes the exact mutual position of the telescoping rod and cylinder, and which thus defines the height of the dunk-ring.

Behind rear joke 11 frame 1 carries a number of ballast bars 36 which are hidden from view by cover 37. Behind this bunch of ballast bars the base frame carries a pair of bumpers 38 upon which rear joke 11 will come to rest in the storage position of the stand.

FIG. 3 gives a clearer understanding of the spring-based system of raising the basketball-stand into its playing position. This figure represents a broken out part of the structure at the far end, viewed under the same angle as FIG. 2. Recognizable are the far longer sides of base frame 24, girder 5, rear pivot spindle 29, joke 11 and strut 30, front pivot spindle 27 and strut 28 to which lever arm 18 is affixed such as by welding. Profile 24 is visible as being affixed to base-frame 24 so as to constitute the fixation element 39 for the one ends of a series of springs 21. While in FIG. 2 the first four springs 21 are visible as part of the spring packet, FIG. 3 shows the sixth spring. The opposite ends of springs 21 engage a common element such as what is a tube 20 in the embodiment which is being represented. On either end of tube 20 there is a rod 19 which engages a hole in lever arm 18.

FIGS. 1 and 3 represent the storage position, in which springs 21 are elongated. The force of the springs 21 pulls rods 19 which exerts a moment of force to the end of lever arm 18 around the pivot axis of pivot spindle 27 which, as stated above, will cause movement of jokes 10 and 11 as well as beam 15 into the playing position. In playing position pivot spindle 27 will have made a turn of about 90°, so that in this playing or higher position lever arm 18 will point about 45° downwardly rearwardly with respect to the pivot axis of pivot spindle 27, and this is why, in FIG. 2, only a small part of lever arm 18 remains visible, because the remainder disappears behind pivot spindle 27.

Near each of its front corners the base-frame 24 is provided with locking pins such as 58 which can be lifted manually and be made to sink into the floor holes in order to prevent the basketball-stand from moving over the floor during the game by players bumping against it or by other causes.

The basketball-stand described so far is known and has been manufactured by the assignee company.

Figure 4:
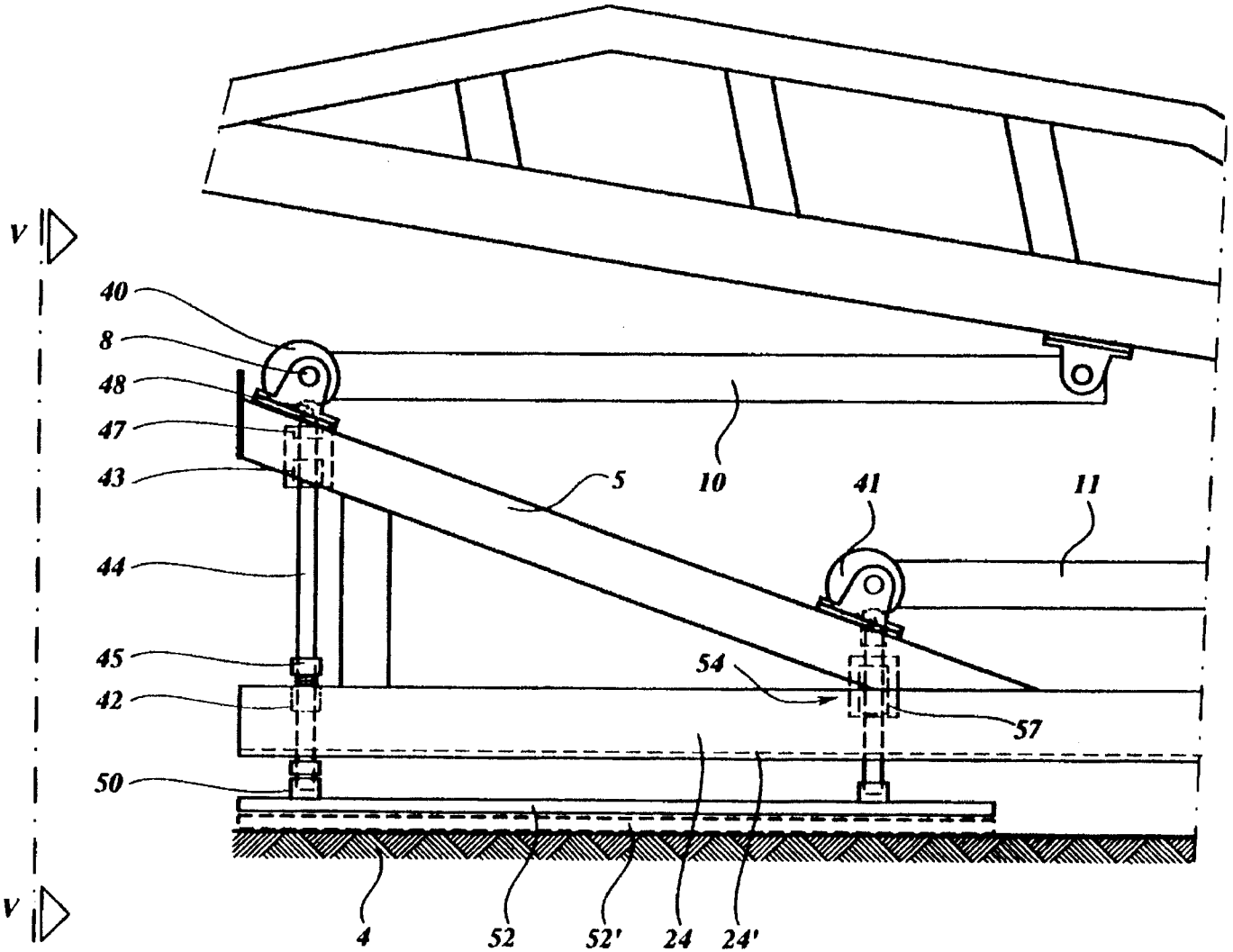
FIG. 4 represents diagrammatically and partially, seen in a similar side view as in FIG. 1, details of the cam and rod systems of this invention, part of the jokes being broken away in order to make essential parts of the invention clearly visible.
Figure 5:
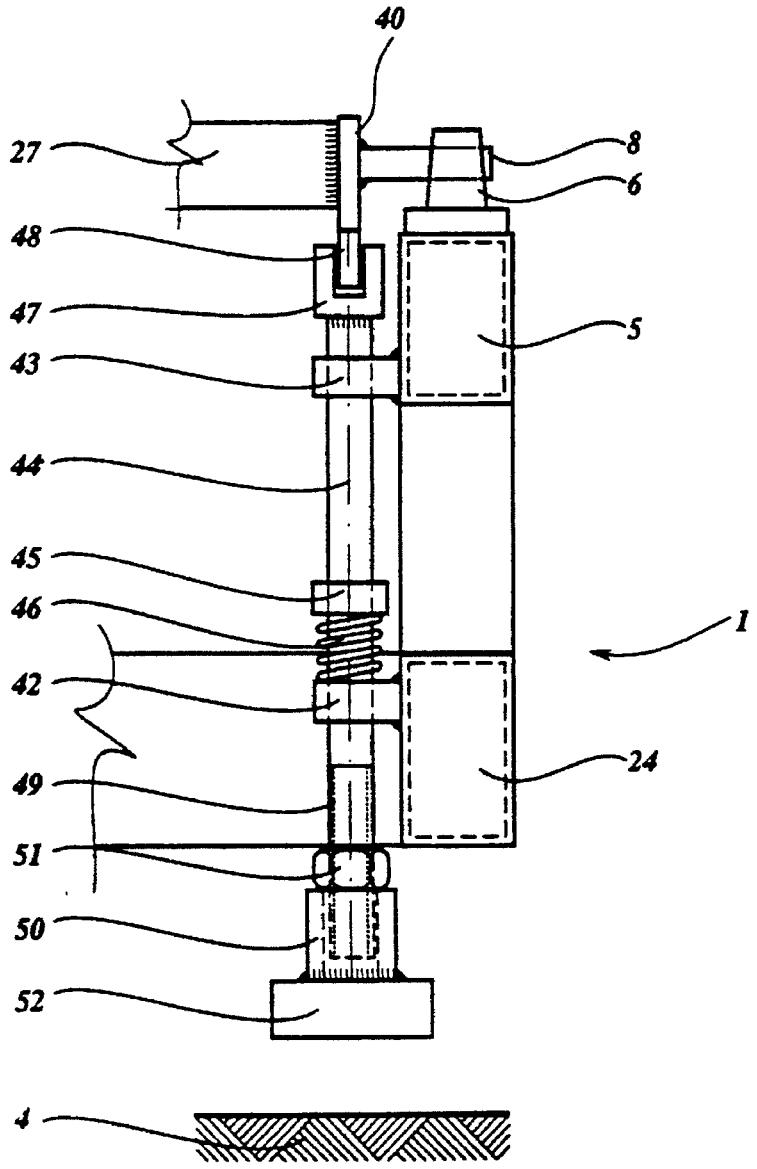
FIG. 5 shows one such cam and rod system as seen according to arrows V—V in FIG. 4.

Now, according to the invention, eccentric cams 40 are attached to either end of front pivot spindle 27 such that the pivot pins still project and can be bourn by bearing blocks 6 (see FIG. 2)., Similarly eccentric cams 41 have been attached at either end of rear pivot spindle 29, again such that pivot pins 9 still project and are carried by the associated bearing blocks 7. Reference is further made to FIGS. 4–6. One lifting system according to the invention will be described in detail.

As appears from FIG. 5, two guide members are fixedly attached to the base, at the inside thereof, one such element 42 to base frame 24, and one such element 43 to girder 5 vertically above element 42, and coaxial with respect thereto. Apertures in each of these elements serve to guide a rod 44, so that this rod is capable of moving up and down. At a place inbetween guide element 42, 43 a strutring 45 has been fixed around rod 44, for example in known manner by a set-screw. Inbetween ring 45 and guide element 42 a spiral spring 46 surrounds rod 44, resting against and inbetween guidemember 44 and ring 45.

On top of rod 44 a fork-shaped support member 47 is permanently attached, preferably by welding, the arms of which carry between them a roller bearing 48, such that the axis of rotation thereof is substantially horizontal and is parallel to the pivot axis of pivot spindle 27 and pivot pin 8, respectively. Seen in lengthwise direction of FIG. 5 roller bearing 48 is located below cam 40, and seen in lateral direction according to FIG. 4 the axis of rotation of roller bearing 48 is located right below pivot axis of pivot pin 8 (at least this is the preferred position, although a place not exactly vertically below the pivot axis would also function).

The lower end of rod 44 is threaded as at 49 so that a footpiece 50 with a threaded bore is vertically adjustable with respect to rod 44, there being a check nut 51 to fix the height position once adjusted.

Foot 50 is permanently attached to a lath 52 of a U-shaped lath frame. This lath frame comprises two such laths 52 extending lengthwise below frame 1, as appears from FIGS. 4 and 2, a cross lath 53 which is only visible in figure and a lath in lengthwise direction at the other side, similar to lath 52. The length of lath 52 has been chosen such that another rod system can be placed upon it, indicated as a whole in FIG. 4 by 54, placed further rear-wardly along frame 1 below the eccentric cam 41 of rear block 11. As appears from FIGS. 2 and 3 a rod system 55 similar to the one described with reference to FIG. 5 is arranged at the far side of the frame, and as appears only from FIG. 3, a rod system 56 has been provided at the far side below cam 41, similar to rod system 54. A difference between the front rod systems cooperating with cams 40 and the rear rod systems cooperating with cams 41 is evidently their length. Another difference is that, in view of the limited vertical space available, there are no two guide members but only one, indicated in FIG. 4 by 57, the vertical dimension of which is greater than the vertical dimensions of each of elements 42 and 43, sufficient to provide a smooth and stable sliding function on the rod within the guide member.

The two cam members 40 and the two cam members 41 all have the same cam profile, which appears most clearly from FIG. 6. At the left in this figure bearing 48 touches a position on the peripheral cam surface of a relatively small radius with respect to its axis of rotation, and this is the position of FIG. 4 corresponding to the lower or storage position of the basketball-stand. It allows the rod such as 44 which carries this bearing 48 to move up, thereby keeping the left frame 52, 53 to stay free above the floor 4. The position of cam 40 to the right in FIG. 6 is the one in which cam 40 has been rotated through about 90° anto clockwise, which is the result of letting the energy stored in the packet of springs push the basketball-stand into its higher or playing position, as in FIG. 2. This makes bearing 48 touch the circumferential cam surface at a place which has a higher radius, urging bearing 48 and the rod which carries it downwardly—compare the difference in height in FIG. 6—resulting in the lath frame 52, 53 to be urged downwardly into such a firm contact with floor 4 that the basketball-stand as a whole will be slightly lifted off the ground. This makes wheels 2 and 3 loose grip so that the stand will not roll any more. In FIG. 4 positions of lath 52 and base frame 24 in this raised condition of the stand are indicated by broken lines 52' and 24' respectively. Finally, in the usual manner, letting the two locking pins 58 drop into corresponding floor holes will definitively prevent the stand from being pushed away by one reason or another from the correct position relative to the playing field.

While a presently preferred embodiment has been shown and described, the invention can be realized in other ways. Cross lath 53, for example, could be omitted while the two laths 52 on either longitudinal side remain as shown. It is also feasible to provide for one cross lath such as 53 upon which the two systems of rods 44 and 55, controlled by the cams 40 on the opposite ends of front pivot spindle 27, and there being another such cross lath operated by the two rod systems controlled by cams 41 on the opposite ends of rear pivot spindle 29, without making the cross laths connected in lengthwise direction. It is also feasible to provide only one eccentric cam and one rod system more or less in the middle of pivot spindle 27 and another one in the middle of pivot spindle 29. When these centrally arranged rod systems would urge floor laths such as 53 of sufficient strength and sufficient length in lateral direction, proper stability of the basketball-stand can also be obtained.

Also different solutions can be used to drive rod means for lifting the stand off the floor by utilizing the power stored in resilient means which are charged when the stand is brought from its playing position into it storage position. Vertically slidable rod means are not essential. Numerous ways are feasible to utilize the energy stored to lift the basketball-stand, such as lever systems. It is not even necessary that lifting the basketball-stand in order to prevent its rolling away has been done simultaneously with lifting the beam which carries the backboard and the ring; to the contrary it is feasible to first lift the stand as soon as it has been rolled towards its proper place with respect to the field, using the power stored in the power storage system, and then use the remainder of the power in the storage system to raise the basketball-stand into its playing position.

Furthermore it will be obvious that the idea of this invention can also be implemented with basketball-stand of a different construction, for example of a type in which the system of links which is formed by the base, the two yokes and the beam has different dimensions so that it deviates far more from the shape of a parallellogram. The invention will also work when the packet of springs is realized as compression springs rather than draw springs. The essential idea of the invention is that the source of power for raising the stand into its playing position is also utilized to lift the stand as a whole to the extent required to make the wheels ineffective during the game.

What is claimed is:

1. A basketball-stand, comprising a base which carries at least one support system which in turn carries a beam provided with means for attachment of a back-board and dunk ring, said beam—and thereby the stand—being capable of being moved between a lower or storage position and a higher or playing position, power storage means being provided, acting between a point connected to said base and a point connected to said at least one support system, and accumulating power when the stand is brought into its storage position, which power is relieved and the accumulated energy allowed to be freed when the stand is brought into its playing position, said base frame carrying means, capable of being driven by said power storage means for lifting at least part of the weight of the stand from the floor.

2. A basketball-stand as in claim 1, wherein said base pivotally carries two support systems which in turn pivotally carry said beam, all pivotal connections having their axes parallel to one another so that a quadrangular system of links is formed by which said beam—and thereby the stand—can be moved between a lower or storage position and a higher or playing position.

3. A basketball-stand as in claim 1, wherein said power storage means are resilient means.

4. A basketball-stand as in claim 1, wherein said means capable of being driven by said power storage means comprise cam and rod means, said at least one support system being provided with at least one eccentric cam, fixedly connected thereto at a place such that the axis of rotation of the eccentric cam coincides with the pivot axis of that particular support system relative to said base, said base slidably vertically carrying rod means, the upper end of which is capable of being driven by an element which is located opposite the cam surface of said eccentric cam such that said element will be displaced by the eccentric cam surface to the extent that, during rotation of said eccentric cam, the cam radius increases from a lower to a higher radius value, said rod means being arranged such that, when it slides, under control of the displacement of said element, it is capable of lifting at least part of the weight of the stand from the floor.

5. A basketball-stand as in claim 1, comprising two support systems, wherein said support systems are resilient means, said support systems being provided with at least one eccentric cam, fixedly connected thereto at a place such that the axis of rotation of the eccentric cam coincides with the pivot axis of that particular support system relative to said base, said base slidably vertically carrying rod means, the upper end of which is capable of being driven by an element which is located opposite the cam surface of said eccentric cam such that said element will be displaced by the eccentric cam surface to the extent that, during rotation of said eccentric cam, the cam radius increases from a lower to a higher radius value, said rod means being arranged such that, when it slides, under control of the displacement of said element, it is capable of lifting at least part of the weight of the stand from the floor.

6. A basketball-stand, comprising a base which pivotally carries at least two support systems which in turn pivotally carry a beam provided with means for attachment of a back-board and dunk ring, all pivotal connections having their axes parallel to one another so that a quadrangular system of links is formed by which said beam—and thereby the stand—can be moved between a lower or storage position and a higher or playing position, resilient means being provided, acting between a point connected to said base and a point connected to one of said support systems, such that the resilient means are tensioned and accumulate power when the stand is brought into its storage position, which power is relieved and the accumulated energy allowed to be freed when the stand is brought into its playing position, at least one of said support systems comprising at least one eccentric cam, fixedly connected thereto at a place such that the axis of rotation of the eccentric cam coincides with the pivot axis of that particular support system relative to said base, said base slidably vertically carrying rod means, the upper end of which is capable of being driven by an element which is located opposite the cam surface of said eccentric cam such that said element will be displaced by the eccentric cam surface to the extent that, during rotation of said eccentric cam, the cam radius increases from a lower to a higher radius value, said rod means being arranged such that, when it slides, under control of the displacement of said element, it is capable of lifting at least part of the weight of the stand from the floor.

7. A basketball-stand as in claim 6, wherein at least one of said support systems comprises a pivot spindle which is provided with two eccentric cams cooperating with two vertically slidable rods for lifting the stand.

8. A basketball-stand as in claim 6, wherein at least one of said support systems comprises a pivot spindle which is provided with two eccentric cams cooperating with two vertically slidable rods for lifting the stand, all rods supporting at their lower ends a lath system to rest upon the floor.

* * * * *